US007395759B2

(12) United States Patent
Hoffman et al.

(10) Patent No.: US 7,395,759 B2
(45) Date of Patent: Jul. 8, 2008

(54) SLEEVE FOR A PRINTING MACHINE

(75) Inventors: Eduard Hoffman, Bobingen (DE); Georg Schmid, Neusäß (DE); Christian Sameit, Augsburg (DE); Angelika Keck, München (DE)

(73) Assignee: MAN Roland Druckmaschinen AG, Offenbach (DE)

( * ) Notice: Subject to any disclaimer, the term of this patent is extended or adjusted under 35 U.S.C. 154(b) by 38 days.

(21) Appl. No.: 11/116,973

(22) Filed: Apr. 28, 2005

(65) Prior Publication Data

US 2005/0241502 A1 Nov. 3, 2005

(30) Foreign Application Priority Data

Apr. 30, 2004 (DE) ..... 10 2004 021 490

(51) Int. Cl.
*B41F 13/10* (2006.01)

(52) U.S. Cl. ..... 101/376; 101/217; 101/379; 428/36.91; 428/909; 492/56

(58) Field of Classification Search ..... 101/376, 101/217, 379; 428/36.91, 909, 304.4; 492/49, 492/50, 51, 52, 56
See application file for complete search history.

(56) References Cited

U.S. PATENT DOCUMENTS 3,819,471 A * 6/1974 Sohnemann ..... 428/411.1
5,351,615 A * 10/1994 Kobler et al. ..... 101/217
5,456,171 A * 10/1995 Biava et al. ..... 101/122
5,654,100 A * 8/1997 Kobler et al. ..... 428/390
5,840,386 A * 11/1998 Hatch et al. ..... 428/36.9
6,148,725 A * 11/2000 Knauer et al. ..... 101/217
6,205,922 B1 * 3/2001 Henry et al. ..... 101/376
6,401,613 B1 * 6/2002 Gayle et al. ..... 101/375
6,703,095 B2 * 3/2004 Busshoff et al. ..... 428/36.91
6,799,512 B2 * 10/2004 Hoffmann et al. ..... 101/376
6,969,543 B1 * 11/2005 Aronhime et al. ..... 428/32.5
2002/0023562 A1 * 2/2002 Busshoff ..... 101/376
2003/0037687 A1 * 2/2003 Aubanel ..... 101/382.1
2004/0045467 A1 * 3/2004 Nakagaki ..... 101/477
2005/0235849 A1 * 10/2005 Lorig et al. ..... 101/375

FOREIGN PATENT DOCUMENTS

| | | |
|---|---|---|
| DE | 1 165 046 | 3/1964 |
| DE | 3 720 378 | 12/1987 |
| EP | 0 571 909 | 12/1993 |
| EP | 0 594 986 | 5/1994 |
| EP | 1 112 860 | 7/2001 |
| EP | 1 275 520 | 1/2003 |

* cited by examiner

*Primary Examiner*—Daniel J. Colilla
*Assistant Examiner*—Kevin D Williams
(74) *Attorney, Agent, or Firm*—Leydig, Voit & Mayer, Ltd

(57) ABSTRACT

The invention relates to a sleeve, particularly a rubber blanket sheath, for a printing machine. The sleeve (10) has a two-layer structure comprising an internal layer designed as support layer (11), and an external layer designed as cover layer (12) and used for the print transfer, with the external or cover layer (12) being connected directly to the internal or support layer (11). A three layer composite sheath also is disclosed.

11 Claims, 1 Drawing Sheet

SLEEVE FOR A PRINTING MACHINE

FIELD OF THE INVENTION

The present invention relates to a sheet transfer sleeve, and more particularly, to a rubber blanket sheath for a printing machine.

BACKGROUND OF THE INVENTION

Blanket sleeves in printing machines promote a quite and smooth pay out from successive printing machine cylinders as a result of the absence of a disruption by gripping channels which are usually present on the circumference of printing and transfer cylinders.

DE 199 50 643 A1 discloses a sleeve with a four-layer overall structure for a web-fed offset rotary printing press. The sleeve according to DE 199 50 643 A1 has an internal layer designed as a support layer, namely a metal sheath, as well as an external layer designed as cover and used for the print transfer, where two additional layers being provided between the support layer and the cover layer. The internal support layer is adjacent to a compressible layer, while the external cover layer is adjacent to a layer made of an inelastic material. The compressible layer adjacent to the support layer and the layer made of inelastic material adjacent to the cover layer are connected to each other. Such a four-layer sleeve design requires considerable manufacturing effort and is therefore expensive.

OBJECTS AND SUMMARY OF THE INVENTION

It is an object of the present invention to provide an improved, more economical, rubber blanket sleeve for a printing machine.

According to one aspect of the invention, a sleeve is provided, and particularly a rubber blanket sheath for a printing machine, with a two-layer structure that comprises an internal layer designed as a support layer, and an external layer designed as a cover layer and used for the print transfer, wherein the external or cover layer is applied directly on the internal or support layer.

According to a second aspect of the invention, a sleeve is provided, and particularly a rubber blanket sheath for a printing machine, with a three-layer structure that comprises an internal layer designed as a support layer, an external layer designed as a cover layer and used for the print transfer, and a register layer arranged between the support layer and the cover layer, wherein the external or cover layer and the internal layer or support layer are applied directly onto different sides of the register layer.

Other objects and advantages of the invention will become apparent upon reading the following detailed description and upon reference to the drawings, in which:

Figure 1:
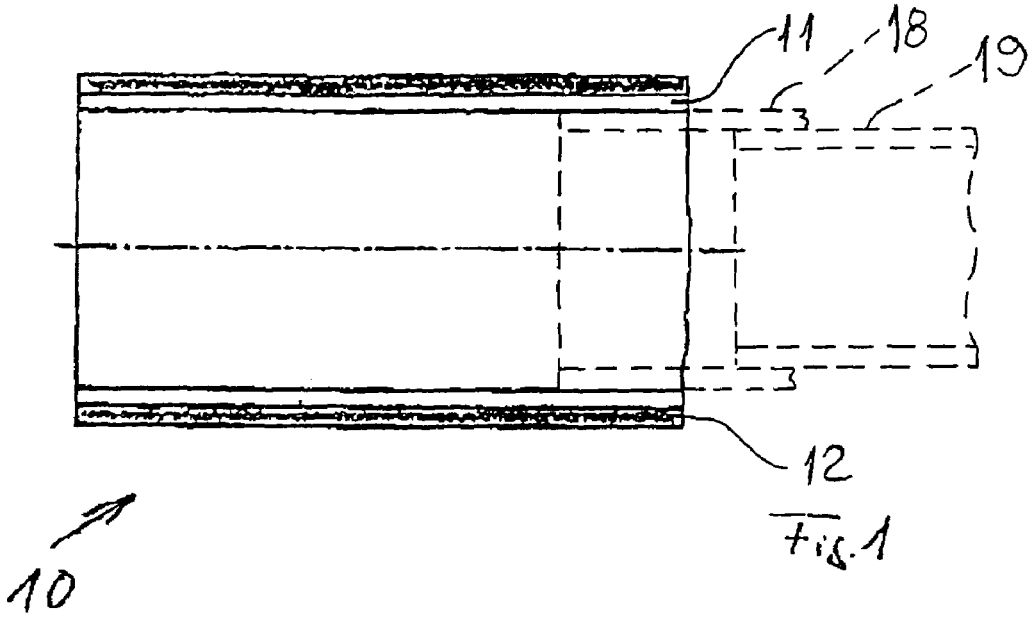
FIG. 1 is a longitudinal, partially diagrammatic section, of a printing machine sleeve in accordance with the invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

Referring more particularly to FIG. 1 of the drawings, there is shown an illustrative blanket sleeve 10 in accordance with the invention for use in an offset printing machine.

In accordance with the invention, the sleeve has a composite construction with a reduced number of discreet layers which simplifies its design and reduces manufacturing costs. The sleeve 10, as depicted in FIG. 1, comprises only two layers, namely the support layer 11 and the cover layer 12. The arrangement on the one hand simplifies the structure of the sleeve, and on the other hand allows manufacturing costs to be reduced.

The support layer 11 preferably is designed to be incompressible. The incompressible support layer 11 can be constructed, for example, using metal. Alternatively, the support layer could be designed to be compressible, preferably being made of a fiber reinforced composite material. Regardless of whether the support layer 11 is designed to be compressible or incompressible, the support layer 11, as well as the cover layer 12, can be fused to an appropriate sleeve or hollow cylinder so as to enable the sleeve 10 to be shifted onto the cylinder of a printing machine.

The internal layer, which is designed as the support layer 11, preferably has a thickness of 0.1 mm to a maximum of 100 mm, so that the support layer 11 can be used to change the print repeat range. The cover layer 12, as indicated, is applied directly onto the support layer 11 and is used for the print transfer. The cover layer 12, which may be designed to be either compressible or incompressible, also preferably has a thickness of 0.1-10 mm. Preferably the cover layer 12 is sealed with a lacquer or other suitable sealing medium.

Figure 2:
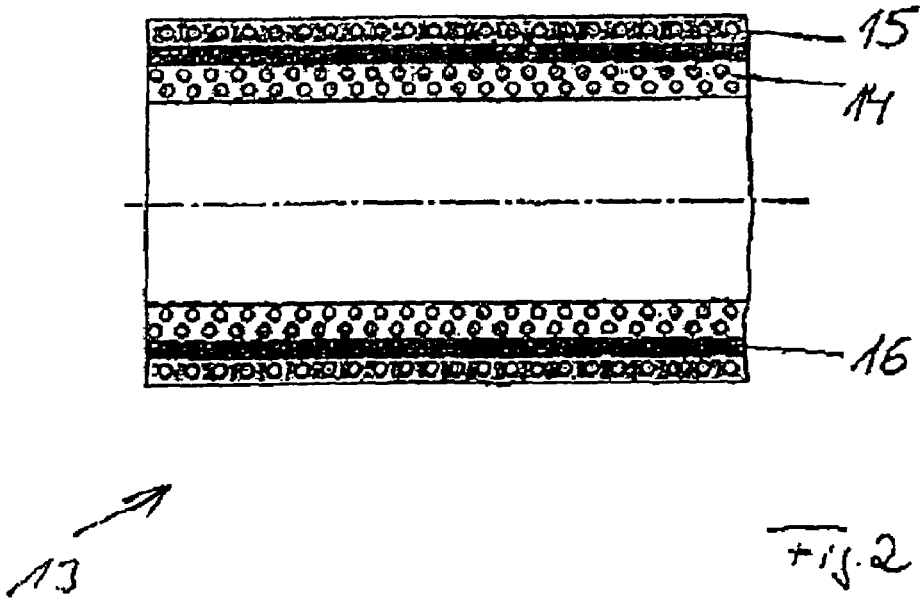
FIG. 2 is a longitudinal section of an alternative embodiment of sleeve for a printing machine in accordance with the invention.

An alternative embodiment of blanket sleeve in accordance with the invention, as depicted in FIG. 2, has a three part or three layer structure. The sleeve in this instance has an internal layer designed as a support layer 14, an external layer designed as a cover layer 15, and a register layer 16 arranged between the support layer 14 and the cover layer 15. The internal layer 14 is connected directly to the inner side of the register layer 16. The cover layer 15 is connected directly to the external side of the register layer 16. In this embodiment, the number of layers of the sleeve again is reduced compared to the state of the art. The sleeve 13 thus also makes it possible to minimize the manufacturing costs.

In the sleeve 13 depicted FIG. 2, the support layer 14 as well as the cover layer 15 are preferably designed to be compressible. The register layer 16 preferably is made of an incompressible hard rubber or fiber-reinforced composite material or a metal material. Alternatively, the support material 14 can be made of an incompressible material and the cover layer could be made of a compressible material, or the support layer 14 could be compressible and the cover layer 15 incompressible, where in each case it is preferred for the register layer 16 to be incompressible.

It will be appreciated by one skilled in the art that the sleeves 10, 13 according to the present invention have particular utility in offset printing machines. Such sleeves generally have no gripping channels, or are designed with only small gripping channels on the cylinders or plate cylinders. Oscillatory or other vibratory movement of the printing cylinder is thus minimized so that the sleeves can be effectively used in the transfer of sheet material in the printing press without adversely effecting printing quality. It will be understood that the sleeves 10, 13 according to the invention each can have an overall flexible design so they can be pulled, like a sock, onto an appropriate support sheath or hollow cylinder 18 and then placed together with the support sheath on a cylinder 19 of a printing machine, as depicted in FIG. 1. Alternatively, the support layer could be fused to the support sheath or mounted directly on the printing machine cylinder.

The invention claimed is:

1. A blanket sleeve for positioning onto a cylinder of an offset printing machine comprising a composite blanket sheath having a two layer structure consisting solely of an internal support layer (11) and an external cover layer (12) that is sealed with lacquer, said external cover layer (12) being directly connected to the internal support layer (11) and having an outer surface for receiving prints from a printing plate and transferring such prints to a printing medium during an offset printing operation, a hollow support cylinder, said composite blanket sheath being flexible for enabling said composite blanket sheath to be axially stretched over said hollow support cylinder into mounted position on the hollow support cylinder, and said hollow support cylinder and mounted composite blanket sheath being positionable into mounted relation on an offset printing machine cylinder.

2. The sleeve of claim 1 in which the support layer is made of a compressible material.

3. The support layer of claim 2 in which the support layer (11) is made of fiber reinforced composite material.

4. The sleeve of claim 1 in which said support layer (11) is fused to said hollow support cylinder which in turn is removeably positionable onto a cylinder of a printing machine.

5. The sleeve of claim 1 in which the support layer (11) has a thickness of 0.1-100 mm.

6. The sleeve of claim 5 in which the cover layer (12) has a thickness of 0.1-10 mm.

7. A blanket sleeve for mounting on a cylinder of an offset printing machine comprising a composite blanket sheath having a three layer construction consisting solely of an internal layer designed as a support layer (14), an external layer designed as cover layer (15) having an outer surface that is sealed with lacquer for receiving prints from a printing plate and transferring such prints to a printing medium during an offset printing operation, and a register layer (16) arranged between the support layer (14) and the cover layer (15), said external cover layer (15) and the internal support layer (14) being directly connected to the register layer (16) on different sides of the register layer (16), a hollow support cylinder, said composite blanket sheath being flexible for permitting said composite blanket sheath to be axially stretched over said hollow support cylinder into mounted position on the hollow support cylinder, and said hollow support cylinder and mounted composite blanket sheath being positionable into mounted relation on an offset printing machine cylinder.

8. The sleeve of claim 7 in which the support layer (14) and the cover layer (15) are compressible and said register layer (16) is incompressible.

9. The sleeve of claim 7 in which said cover layer (15) is compressible and said support layer (14) and register layer (16) are incompressible.

10. The sleeve of claim 7 in which said support layer (14) is compressible and said cover layer (15) and registered layer (16) are incompressible.

11. In an offset printing machine having a rotatable cylinder, comprising a hollow blanket holding cylinder mountable on an offset printing machine cylinder, a composite blanket sleeve mounted on the blanket holding cylinder, said blanket sleeve consisting solely of an internal support layer (11) and an external cover layer (12) that is sealed with lacquer, said cover layer (12) having an outer surface for receiving prints from a printing plate and transferring such prints to a printing medium during an offset printing operation, said external cover layer (12) being directly connected to the internal support layer (11), and said composite blanket sleeve being flexible for enabling said composite blanket sleeve to be axially pulled and stretched over said hollow holding cylinder into mounted position on the hollow holding cylinder.

* * * * *